US009850032B2

(12) United States Patent
Uesugi et al.

(10) Patent No.: US 9,850,032 B2
(45) Date of Patent: Dec. 26, 2017

(54) PACKAGING BAG

(71) Applicant: KYORAKU CO., LTD., Kyoto (JP)

(72) Inventors: Tomohiro Uesugi, Kyoto (JP); Shinji Matsunaga, Kyoto (JP)

(73) Assignee: KYORAKU CO., LTD., Kyoto (JP)

( * ) Notice: Subject to any disclaimer, the term of this patent is extended or adjusted under 35 U.S.C. 154(b) by 0 days.

(21) Appl. No.: 14/771,082

(22) PCT Filed: Feb. 19, 2014

(86) PCT No.: PCT/JP2014/053839

§ 371 (c)(1),
(2) Date: Aug. 27, 2015

(87) PCT Pub. No.: WO2014/132847

PCT Pub. Date: Sep. 4, 2014

(65) Prior Publication Data

US 2016/0137353 A1 May 19, 2016

(30) Foreign Application Priority Data

Feb. 28, 2013 (JP) ..... 2013-039976

(51) Int. Cl.
*B65D 30/08* (2006.01)
*B65D 33/00* (2006.01)
(Continued)

(52) U.S. Cl.
CPC ..... *B65D 31/02* (2013.01); *B65D 31/04* (2013.01); *B65D 33/004* (2013.01); *B65D 33/16* (2013.01); *B65D 35/08* (2013.01)

(58) Field of Classification Search
CPC ..... B32B 27/32; A01N 25/34; A01N 25/10; A01N 2300/00; A01N 63/00; B65D 31/02;
(Continued)

(56) References Cited

U.S. PATENT DOCUMENTS 3,774,837 A * 11/1973 Franson ..... B65D 33/10 383/10
4,303,710 A * 12/1981 Bullard ..... B29C 47/0023 156/229
(Continued)

FOREIGN PATENT DOCUMENTS

JP 1-234285 A 9/1989
JP 8-301297 A 11/1996
(Continued)

OTHER PUBLICATIONS

International Search Report dated May 20, 2014 from corresponding International Patent Application No. PCT/JP2014/053839; 5 pgs.

*Primary Examiner* — Peter Helvey
(74) *Attorney, Agent, or Firm* — Maier & Maier, PLLC

(57) ABSTRACT

Provided is a packaging bag which can prevent a colorant contained in a multilayer film from staining a packaged object, as well as has high mechanical strengths such as high impact resistance and high pinhole resistance. In a packaging bag formed by forming a multifold film into a bag shape, the multifold film being formed by stacking a plurality of multilayer films, a colorant is contained in a layer of the multilayer films, the layer containing the colorant being not in contact with an object to be packaged. For example, the multifold film comprises two stacked multilayer film formed by flattening a tubular multilayer film. For example, the colorant is an inorganic pigment.

2 Claims, 4 Drawing Sheets

(51) Int. Cl.
*B65D 33/16* (2006.01)
*B65D 35/08* (2006.01)

(58) Field of Classification Search
CPC ..... B65D 31/04; B65D 33/004; B65D 33/08; B65D 33/16
USPC ..... 383/109, 113
See application file for complete search history.

(56) References Cited

U.S. PATENT DOCUMENTS 4,357,191 A * 11/1982 Bullard ..... B29C 47/0023 156/244.14
4,390,573 A * 6/1983 Bullard ..... B29C 47/0023 383/116
4,494,264 A * 1/1985 Wattiez ..... D06F 95/006 383/102
4,705,085 A * 11/1987 Brown ..... B65D 81/3881 206/522
4,755,403 A * 7/1988 Ferguson ..... B32B 27/32 383/119
4,765,857 A * 8/1988 Ferguson ..... B32B 27/32 156/229
4,770,731 A * 9/1988 Ferguson ..... B32B 27/32 156/229
4,884,990 A * 12/1989 Lovik ..... A63H 27/10 250/462.1
4,998,666 A * 3/1991 Ewan ..... B65D 33/34 206/459.1
5,060,848 A * 10/1991 Ewan ..... B65D 33/34 206/459.1
5,609,930 A * 3/1997 Matsunaga ..... B32B 27/32 206/554
5,787,838 A * 8/1998 Abrams ..... B65D 31/02 118/13
6,196,960 B1 * 3/2001 Owensby ..... B65B 25/065 383/117
6,254,909 B1 * 7/2001 Williams ..... B31B 1/80 383/119
6,350,461 B1 * 2/2002 Levy ..... A01N 25/10 222/565
6,659,407 B2 * 12/2003 Asaro ..... B65B 67/1205 220/495.11
7,579,061 B2 * 8/2009 Dronzek, Jr. ..... B32B 27/08 206/807
7,824,720 B2 * 11/2010 Unwin ..... A47J 37/0871 220/573.2
8,021,734 B2 * 9/2011 Lippy ..... B29D 22/02 206/522
8,240,546 B2 * 8/2012 Friebe ..... B41M 1/22 229/87.01
2005/0220376 A1 10/2005 Tsukanome et al.
2006/0108405 A1 * 5/2006 Sanchez ..... B65D 27/14 229/80
2008/0068920 A1 * 3/2008 Galliher ..... B01F 3/04106 366/102
2008/0105679 A1 * 5/2008 Ballard ..... B65D 33/007 220/260
2008/0112654 A1 5/2008 Matsunaga
2009/0188211 A1 * 7/2009 Galliher ..... B01F 13/0827 53/434
2010/0143627 A1 6/2010 Inoue et al.
2011/0099956 A1 * 5/2011 Dunn ..... B65F 1/0006 53/567
2011/0182533 A1 * 7/2011 Scott ..... B65D 83/0055 383/119
2011/0308977 A1 * 12/2011 DiLiberto ..... B65D 81/3272 206/222
2012/0057811 A1 * 3/2012 Tucker ..... B31B 1/00 383/72
2012/0269466 A1 * 10/2012 Dorsey ..... B65D 31/02 383/109
2012/0321227 A1 * 12/2012 Kumamoto ..... C09J 163/00 383/107
2013/0028540 A1 * 1/2013 Matsumoto ..... C08G 59/4014 383/107
2013/0089279 A1 * 4/2013 Liao ..... B65D 81/03 383/105
2013/0188889 A1 * 7/2013 Fraser ..... B65D 33/28 383/37
2013/0188891 A1 * 7/2013 Maxwell ..... B65F 1/002 383/75
2014/0355912 A1 * 12/2014 Fortune ..... B32B 27/08 383/113
2014/0376835 A1 * 12/2014 Rogers ..... B32B 5/18 383/207
2015/0030266 A1 * 1/2015 Borchardt ..... B65D 33/00 383/109

FOREIGN PATENT DOCUMENTS

JP 2004-043025 A 2/2004
JP 2004-43025 A 2/2004
JP 2007-100047 A 4/2007
WO 2006/038700 A1 4/2006
WO 2008102733 A1 8/2008
WO 2012-070581 A1 5/2012

* cited by examiner

PACKAGING BAG

TECHNICAL FIELD

The present invention relates to a multifold packaging bag formed by stacking multiple films and, in particular, to a packaging bag colored with a colorant.

BACKGROUND ART

Packaging bags formed by forming, into a bag shape, a multifold film formed by stacking multiple films have been proposed as bags for packaging fluid, semifluid, powder, or the like. In such a packaging bag, the films forming the multifold film are unbonded over a wide range and can sideslip with respect to each other in the unbonded range. Thus, even if a pinhole occurs in one film, the other films can remain intact. Even if one film receives a bending stress, the other film can slide and escape. Therefore, such a packaging bag has advantageous effects, including improvements in mechanical properties such as pinhole resistance and impact resistance.

For example, Patent Literature 1 discloses a packaging bag and a manufacturing method thereof. This packaging bag is formed by bending a multifold film into a tubular shape and then sealing the edges and has containing space for containing an object to be packaged.

CITATION LIST

Patent Literature

Patent Literature 1: Japanese Unexamined Patent Application Publication No. 2004-43025

SUMMARY OF INVENTION

Technical Problem

Such packaging bags may be colored using a colorant such as a pigment or dye for the enhancement of design properties, the discovery of a foreign object, or other purposes. However, the colorant may move to and stain the packaged object.

As described above, the films forming the multifold film are unbonded over a wide range and thus the mechanical properties are improved. However, when the films forming the multifold film have high blocking properties, a pinhole penetrating through multiple films may occur, or the films may fail to slide and escape. This may result in problems such as the degradation of the mechanical properties.

Accordingly, an object of the present invention is to provide a packaging bag that can prevent a colorant contained in a multifold film from staining a packaged object and in which the films forming the multifold film have low blocking properties and thus high mechanical properties can be maintained.

Solution to Problem

In order to achieve the above object, in a packaging bag formed by forming a multifold film into a bag shape, the multifold film being formed by stacking a plurality of multilayer films, a colorant is contained in a layer of the multilayer films, the layer containing the colorant being not in contact with an object to be packaged.

In the packaging bag of the present invention, the colorant is contained in at least one layer except for the layer in contact with the containing space. Accordingly, the layer containing the colorant does not contact the packaged object, thereby preventing the colorant from moving to the packaged object.

In the packaging bag of the present invention, the colorant is preferably contained in at least a layer of one of adjacent two multilayer films forming the multifold film, the layer being in contact with the other multilayer film.

If the colorant is contained in at least a layer of one of adjacent two multilayer films of the multilayer films forming the multifold multilayer film in the packaging bag, the layer being in contact with the other multilayer film, the blocking properties of the one multilayer film and the other multilayer film can be reduced.

Effects of Invention

According to the present invention, the layer containing the colorant does not contact the packaged object, thereby preventing the colorant from moving to the packaged object. Thus, it is possible to provide a packaging bag that can prevent a packaged object from being stained by a colorant. Further, if the colorant is contained in a layer of one of adjacent two multilayer films, the layer being in contact with the other multilayer film, it is possible to provide a packaging bag in which the multilayer films have low blocking properties and thus high mechanical properties such as high impact resistance and high pinhole resistance can be maintained.

BRIEF DESCRIPTION OF THE DRAWINGS

FIG. 1 include diagrams schematically showing the configuration of a packaging bag of an embodiment of the present invention, in which FIG. 1(A) is a perspective view of a multifold multilayer film forming the packaging bag; FIG. 1(B) is a detailed perspective view of the multifold multilayer film; FIG. 1(C) is a perspective view showing an aspect in which the multifold multilayer film is bent into a tubular shape; FIG. 1(D) is a perspective view showing a state in which a longitudinal seal is attached to the stacked edge of the multifold multilayer film bent into the tubular shape; and FIG. 1(E) is a perspective view of a packaging bag formed by attaching transverse seals to the upper and lower edges of the multifold multilayer film.

DESCRIPTION OF EMBODIMENTS

Now, an embodiment of a packaging bag and a manufacturing method thereof according to the present invention will be described in detail with reference to the drawings.

Figure 1:
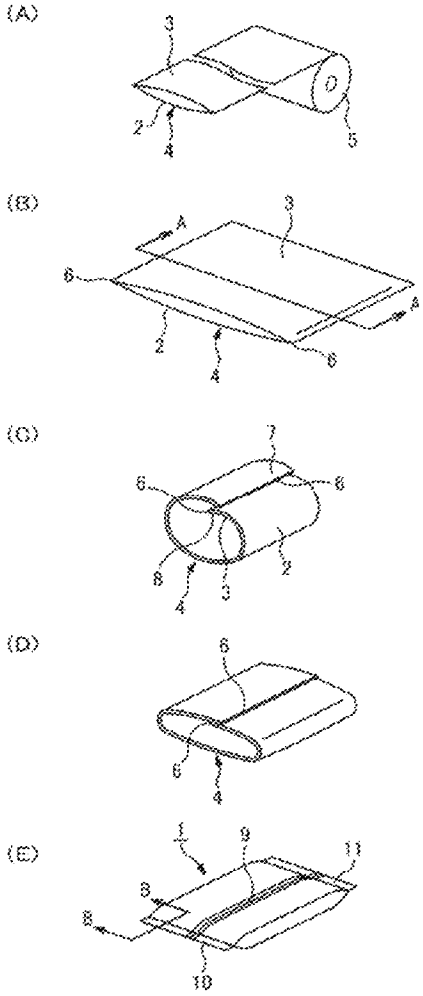

In the present embodiment, a packaging bag 1 sealed using envelope seaming will be described as an example. First, the configuration of the packaging bag 1 will be outlined. FIG. 1 include drawings showing the configuration of the packaging bag 1 of the present embodiment.

FIG. 1(A) is a perspective view of a multifold multilayer film 4, and FIG. 1(B) is a detailed perspective view of the multifold multilayer film 4. The multifold multilayer film 4 of the present embodiment is formed by flattening a tubular multilayer film formed using a known inflation method and acts as two multilayer films (inner multilayer film 2 and outer multilayer film 3) having edges 6 as the boundaries therebetween. More specifically, the multifold multilayer film 4 is formed by cutting off a predetermined-length region from a roll film 5 formed by flattening and winding up a tubular film. Thus, in the multifold multilayer film 4, the inner multilayer film 2 and outer multilayer film 3 are stacked and connected together at edges 6 serving as the boundaries therebetween. The method for forming a multifold film acting as two multilayer films is not limited to the inflation method, and any other known technologies, including a method of pseudo-bonding two films together by roll press, may be used as appropriate.

Subsequently, as shown in FIG. 1(C), the multifold multilayer film 4 is bent into a tubular shape, and edge portions 7 and 8 thereof are stacked in such a manner that one edge portion, 7, covers the other, 8. Then, as shown in FIGS. 1(D) and 1(E), a longitudinal seal 9 is formed in the region in which the edges 7 and 8 are stacked, along the edges 6 in the length direction so that the edges 7 and 8 are bonded together. Further, transverse seals 10 and 11 are formed at upper and lower edges perpendicular to the longitudinal seal 9, of the tubular multifold multilayer film 4 in such a manner that the transverse seals 10 and 11 cross the longitudinal seal 9. In this way, the multifold multilayer film 4 is formed into a packaging bag 1 having containing space. An object to be packaged is filled into the containing space in the manufacturing process. While the packaging bag 1 is formed using envelope seaming in the present embodiment, any other methods, including butt seaming, in which edge portions of the inner multilayer film 2 are sealed longitudinally, may be used as appropriate.

Figure 2:
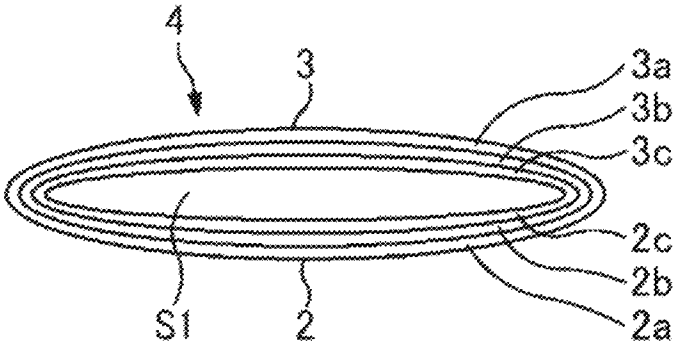
FIG. 2 is an A-A sectional view of the multifold multilayer film of the embodiment.

In the packaging bag 1 thus configured, a colorant is contained in only at least one layer except for the layer in contact with the packaged object (containing space), that is, except for the outermost layer of the tubular multilayer film. Hereafter, the layer configuration of the packaging bag 1 will be described in detail. FIG. 2 is a sectional view taken along line A-A of the multifold multilayer film 4 shown in FIG. 1(B). The multifold multilayer film 4 consists of the inner multilayer film 2 and outer multilayer film 3, which are connected together and form a tubular shape. The multilayer films 2 and 3 have the connected edges as the boundaries therebetween and each consist of multiple layers. In the inner multilayer film 2, a first layer 2*c*, a second layer 2*b*, and a third layer 2*a* are stacked on the unbonded surface S1 thereof in this order. Similarly, in the outer multilayer film 3, a first layer 3*c*, a second layer 3*b*, and a third layer 3*a* are stacked on the unbonded surface S1 thereof in this order. The first layers 2*c* and 3*c* are formed of a resin having low blocking properties so that the multifold multilayer film 4 can act as two films. Preferred examples of such a resin include one containing an anti-blocking agent. The second layers 2*b* and 3*b* are formed of a base resin so that the multifold multilayer film 4 can exhibit good mechanical properties as a packaging bag. The third layers 2*a* and 3*a* are the outermost layer of the packaging bag and the layer to be contacted with the object to be packaged, respectively, and are formed of a resin which is suitably sealed. The first layers 2*c* and 3*c* and/or second layers 2*b* and 3*b* contain a colorant. Preferably, at least the first layers 2*c* and 3*c* contain a colorant. If the first layers 2*c* and 3*c* contain a colorant, it is possible to prevent the first layers 2*c* and 3*c* from blocking each other at the same time when the packaging bag is colored. Thus, the packaging bag 1 can maintain the good suitability as a multifold bag. Examples of the colorant include a pigment and a dye. As shown in FIG. 1(C), by bending the multifold multilayer film 4 into a tubular shape while positioning the inner multilayer film 2 in an inner position, the packaging bag 1 can be formed as a packaging bag which has high pinhole resistance and can avoid the colorant from moving to the packaged object.

Figure 3:
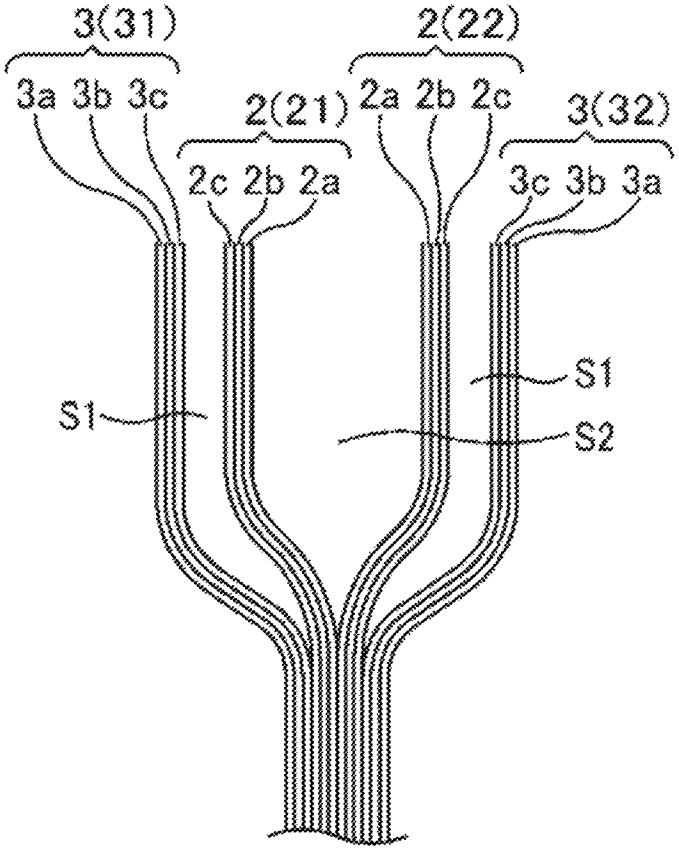
FIG. 3 is a B-B sectional view of the packaging bag of the embodiment.

FIG. 3 is a B-B sectional view of the packaging bag 1 and is a partial sectional view showing a region including the transverse seal 10, of the packaging bag 1. Containing space S2 for containing an object to be packaged is formed between the side of the packaging bag 1 on which the longitudinal seal 9 is formed (hereafter referred to as "the front side") and the side opposite to the front side (hereafter referred to as "the back side").

The front side consists of the inner multilayer film 2 (21) and outer multilayer film 3 (31), and the back side consists of the inner multilayer film 2 (22) and outer multilayer film 3 (32). In the regions other than the longitudinal seal 9 and transverse seals 10 and 11, the inner multilayer film 2 and outer multilayer film 3 are not bonded together and can move (sideslip or contact/separate) with respect to each other. Note that in FIG. 3, the unbonded surface S1 between the inner multilayer film 2 and outer multilayer film 3 is illustrative of the unbonded state. The multilayer films 2 and 3 may be in contact with each other in some or all regions.

In the inner multilayer film 2, the third layer 2*a*, the second layer 2*b*, and the first layer 2*c* are disposed in this order from the side thereof adjacent to the containing space S2. That is, the colorant is contained in the layer (first layer 2*c*) which is not the third layer 2*a*, which is in contact with the containing space S2. Since the colorant contained in the first layer 2*c* does not move to the packaged object contained in the containing space S2, it is possible to prevent the colorant from staining the packaged object.

In the outer multilayer film 3, the first layer 3*c*, the second layer 3*b*, and the third layer 3*a* are disposed in this order from the side thereof adjacent to the inner multilayer film 2. That is, the first layer 3*c* adjacent to the inner multilayer film 2, of the outer multilayer film 3 and the first layer 2*c* adjacent to the outer multilayer film 3, of the inner multilayer film 2 contain the colorant. For the above reasons, the embodiment of the present invention can reduce the blocking properties of the outer multilayer film 3 and inner multilayer film 2. Thus, advantageous effects can be obtained, including the maintenance of the high mechanical strengths, such as the high impact resistance and high pinhole resistance, of the packaging bag 1. While known materials such as an organic synthetic dye (tar dye), natural dye, and inorganic pigment may be used as the colorant as appropriate, an inorganic pigment is preferred in terms of the blocking properties.

As shown in FIG. 2, the multifold multilayer film 4 comprises two stacked multilayer film formed by flattening the tubular multilayer film whose innermost layers are the first layers 2*c* and 3*c* containing the colorant. Thus, the multifold multilayer film 4 can prevent the colorant from staining the packaged object, as well as can reduce the blocking properties.

Figure 4:
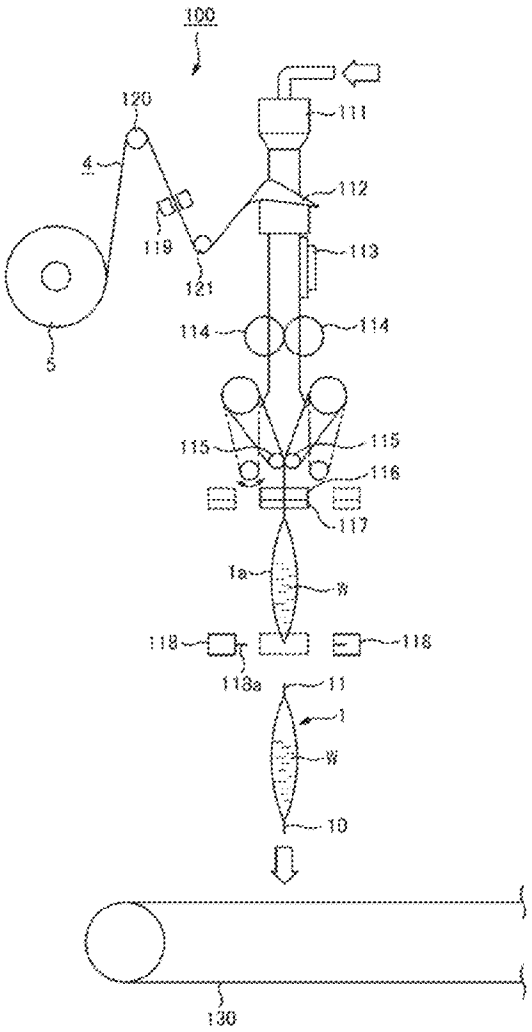
FIG. 4 is a diagram showing a method for manufacturing the packaging bag of the embodiment.

Next, a method for manufacturing the packaging bag 1 will be described using a case in which it is manufactured using a pillow packaging machine 100 as shown in FIG. 4. The following steps are sequentially performed: a first step in which a multifold multilayer film 4 is formed into a tubular shape; a second step in which a longitudinal seal 9 is formed; a third step in which a lower transverse seal 10 is formed; a fourth step in which an object to be packaged W is filled; a fifth step in which an upper transverse seal 11 is formed; and a sixth step in which the boundaries between connected bags are cut. The respective steps will be described below.

The first step in which a multifold multilayer film is formed into a tubular shape: a multifold multilayer film 4 obtained from a roll film 5 travels around feed rolls 120 and 121 and is led to a former 112. A sensor 119 is disposed on the path from the roll film 5 to the former 112. The sensor 119 detects register marks printed on the multifold multilayer films 4 at predetermined intervals in the length direction so that the multifold multilayer films 4 each having a predetermined length can be fed onto the path in the packaging machine 100 at predetermined time intervals. During the passage through the former 112, each multifold multilayer film 4 is bent into a tubular body in which the edges 7 and 8 of the bent multifold multilayer film overlap each other. More specifically, the multifold multilayer film 4 in which the first layers 2*c* and 3*c*, second layers 2*b* and 3*b*, and third layers 2*a* and 3*a* are stacked in this order from the inside, as shown in FIG. 2, is bent into a tubular body. Thus, the third layer 2*a* of the inner multilayer film 2 forms the inner surface of the tubular body. The tubular body has a multifold structure in which the outer multilayer film 3 is stacked on the outside of the inner multilayer film 2, and the first layer 2*c* containing the colorant, of the inner multilayer film 2 and the first layer 3*c* containing the colorant, of the outer multilayer film 3 are in contact with each other.

The second step in which a longitudinal seal is formed: at the timing when a multifold multilayer film 4 moves at a predetermined time interval, a longitudinal sealer 113 heat-seals the overlapping edges 7 and 8 of the multifold multilayer film 4 by contacting the contact surfaces thereof with each other or separate them from each other, thereby forming a longitudinal seal 9.

The third step in which a lower transverse seal is formed: after the longitudinal sealer 113 completes the heat-sealing, a squeezing roll 115 is closed to squeeze the tubular body formed from the multifold multilayer film 4. Then, transversely sealing machines 116 and 117 are closed to form a lower transverse seal 10 in a predetermined position of the flattened tubular body.

The fourth step in which an object to be packaged is filled: a predetermined amount of an object W to be packaged is introduced into a hopper 111 and thus filled into the tubular body.

The fifth step in which an upper transverse seal is formed: a predetermined length of a yet-to-be-separated packaging bag 1*a*, the tubular body and the multifold multilayer film 4 following the tubular body are fed by opening the squeezing roll 115 and transversely sealing machines 116 and 117 and then rotating the feed roll 114. Then, the transversely sealing machines 116 and 117 are closed to heat-seal a predetermined position, thereby forming an upper transverse seal 11, as well as forming a lower transverse seal 10 connected to the upper transverse seal 11, of a subsequent packaging bag located upstream of the path.

The sixth step in which the boundary between connected bags are cut: a press/cutter 118 is closed to press the lower transverse seal 10 of the yet-to-be-separated packaging bag 1*a* and the upper transverse seal 11 connected to the transverse seal 10, then cuts the boundary between both the upper transverse seal 11 and the transverse seal 10, and drops a packaging bag 1 onto a conveyor 130.

In this way, the packaging bag 1 shown in FIG. 1(E) is manufactured. The packaging bag 1 can prevent the colorant from moving to and staining the packaged object W. The packaging bag 1 also has advantageous effects, including the reductions in the blocking properties of the inner multilayer film 2 and outer multilayer film 3 and the maintenance of the high mechanical strengths.

While the embodiment of the present invention has been described, the invention is not limited thereto, as a matter of course. Various changes or modifications can be made thereto without departing from the spirit and scope of the invention.

For example, the multifold multilayer film does not have to be tubular and may be formed by stacking multiple separate multilayer films.

The multifold multilayer film may be a twofold multilayer film, in which two multilayer films are stacked, or may be any other multifold multilayer film, in which three or more multilayer films are stacked.

The colorant may be contained in only one multilayer film of the multifold multilayer film, or may be contained in the multiple multilayer films thereof. The colorant may also be contained in only one layer of each multilayer film, or may be contained in two or more of the multiple films.

Each multilayer film may consist of two layers or three or more layers. The colorant may be contained in an intermediate layer of a multilayer film. However, in terms of the blocking properties, the colorant is preferably contained in a layer of one of adjacent two multilayer films, the layer being in contact with the other multilayer film.

The stacked part of the packaging bag may be formed using butt seaming. The number of seals or the positions of the seals is not particularly limited. For example, three-side sealing or four-side sealing may be used.

DESCRIPTION OF NUMERALS

1 packaging bag
2 inner multilayer film
2*a* third layer
2*b* second layer
2*c* first layer containing colorant
3 outer multilayer film
3*a* third layer
3*b* second layer
3*c* first layer containing colorant
4 multifold multilayer film
41 front surface of multifold multilayer film
42 back surface of multifold multilayer film
5 multifold multilayer roll film
6 side edge of multifold multilayer film
7 overlapping one edge of multifold multilayer film
8 overlapping other edge of multifold multilayer film
9 longitudinal seal
10 lower transverse seal
11 upper transverse seal
12 tubular body
100 packaging machine
112 former

The invention claimed is:

1. A packaging bag comprising:

forming a multifold film into a bag shape, the multifold film being formed by stacking a plurality of multilayer films, wherein a colorant is contained in a layer of the multilayer films, the layer containing the colorant being not in contact with an object to be packaged, wherein the packaging bag is formed using envelope sealing, wherein the multifold film has an inner multilayer film and an outer multilayer film, and wherein an unbonded surface is provided between the inner multilayer film and the outer multilayer film, wherein the inner multilayer film and the outer multilayer film are composed of a plurality of layers, wherein a colorant is contained in at least one layer except for an innermost layer of the plurality of layers of the inner multilayer film, and wherein a colorant is contained in at least one layer except for an outermost layer of the plurality of layers of the outer multilayer film, wherein the inner multilayer film and the outer multilayer film are connected to each other at edge portions in the width direction, and formed by flattening a tubular multilayer film, wherein one edge portion of the width direction of the multifold film and the other edge portion of the width direction of the multi-layer film are bonded together in such a manner that the one edge portion and the other edge portion are stacked, so as to form a tubular shape with the inner multilayer film inside, wherein a longitudinal seal is formed in the region in which the one edge portion and the other edge portion are stacked, wherein containing space is formed by the inner multi-layer film, and wherein the colorant is contained in only an innermost layer of the tubular multilayer.

2. The packaging bag of claim 1, wherein the colorant is an inorganic pigment.

* * * * *